US006402560B1

(12) United States Patent
Lin

(10) Patent No.: US 6,402,560 B1
(45) Date of Patent: Jun. 11, 2002

(54) COMMUNICATION CONNECTOR WITH CROSSTALK COMPENSATION

(75) Inventor: Chen-Chieh Lin, Indianapolis, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/583,503

(22) Filed: May 31, 2000

(51) Int. Cl.[7] ..... H01R 24/04
(52) U.S. Cl. ..... 439/676; 439/941
(58) Field of Search ..... 439/676, 941

(56) References Cited

U.S. PATENT DOCUMENTS

| | | | | |
|---|---|---|---|---|
| 5,186,647 A | | 2/1993 | Denkmann et al. | 439/676 |
| 5,547,405 A | * | 8/1996 | Pinney et al. | 439/676 |
| 5,997,358 A | | 12/1999 | Adriaenssens | 439/676 |
| 6,165,023 A | * | 12/2000 | Troutman et al. | 439/676 |

OTHER PUBLICATIONS

Lucent Technologies, Data Sheet for 657c Printed Wiring Board Jacks (undated).

* cited by examiner

*Primary Examiner*—Renee Luebke
*Assistant Examiner*—Felix O. Figueroa
(74) *Attorney, Agent, or Firm*—Law Office of Leo Zucker

(57) ABSTRACT

A communication connector includes a housing with an opening for receiving a mating connector. First and second pairs of terminal contact wires are supported in the housing, and each pair forms a different signal path. The terminal contact wires have base portions, free ends, and intermediate co-planar contact portions that establish points of electrical contact with corresponding terminals of a mating connector. First and second pairs of elongated, parallel capacitor plates are fixed at corresponding free ends of the contact wires. The plates of each pair of capacitor plates capacitively couple an associated terminal contact wire of the one pair of contact wires, with an associated terminal contact wire of the other pair of contact wires. The two pairs of capacitor plates extend in a length direction that is substantially parallel to the plane of the contact portions of the terminal contact wires. In the disclosed embodiment, the first and the second pairs of parallel capacitor plates extend perpendicular to the contact wires, and are aligned in planes orthogonal to one another.

10 Claims, 3 Drawing Sheets

COMMUNICATION CONNECTOR WITH CROSSTALK COMPENSATION

BACKGROUND OF THE INVENTION

1. Field of the Invention

This invention relates to communication connector constructions that reduce or compensate for crosstalk.

2. Discussion of the Known Art

Communication connector constructions that suppress or compensate for crosstalk between signal paths carried through the connector, are highly desirable. As defined herein, crosstalk arises when signals conducted or carried over a first path, e.g., a pair of terminal contact wires in a communication connector, are partly coupled electromagnetically into a second signal path, e.g., another pair of terminal contact wires in the same connector. The transferred signals may be detected as "crosstalk" in the second path, and such crosstalk degrades existing signals routed over the second path.

For example, a standard type RJ-45 communication connector typically includes four pairs of contact wires defining four different signal paths. In conventional RJ-45 plug and jack connectors, all four pairs of wires extend closely parallel to one another over the lengths of the connectors. Crosstalk may therefore be induced among different pairs of the contact wires, particularly in mated plug and jack combinations. The amplitude of the crosstalk increases as the coupled signal frequencies or data rates increase.

Applicable standards for rating crosstalk performance of communication connectors, do so in terms of near-end crosstalk or "NEXT". The NEXT ratings are usually specified for mated plug and jack combinations, wherein input terminals of the plug connector are used as a reference plane. Communication links using unshielded twisted pairs (UTP) of copper wire are now expected to support data rates up to not only 100 MHz or industry standard "Category 5" performance, but to meet proposed "Category 6" levels which call for at least 46 dB crosstalk loss at 250 MHz.

Crosstalk compensation circuitry may be provided on or within layers of a printed wire board, to which the terminal contact wires of a communication jack are connected. See U.S. Pat. No. 5,997,358 (Dec. 7, 1999) which is assigned to the assignee of the present application and invention. All relevant portions of the '358 patent are incorporated by reference.

U.S. Pat. No. 5,547,405 (Aug. 20, 1996) relates to a crosstalk suppressing connector having first and second signal carrying pairs of elongated, laterally spaced contacts mounted in a housing. An intermediate portion of one contact of one pair is formed to overly an intermediate portion of another contact of the other pair, with a dielectric between the overlying portions to provide capacitive coupling between the associated contacts.

U.S. Pat. No. 6,139,371 issued Oct. 31, 2000, and assigned to the assignee of the present application and invention, relates to a communication connector assembly with capacitive crosstalk compensation. The connector assembly features a number of terminal contact wires having free end portions, with contact portions connecting between the free end portions and base portions of the contact wires. At least a first and a second pair of the contact wires have their free end portions extending to define leading portions. One of the leading portions of the first pair of contact wires, and one of the leading portions of the second pair of contact wires, are dimensioned and arranged for capacitively coupling to one another to produce capacitive crosstalk compensation.

If crosstalk compensation is introduced at locations other than at points of electrical contact between mated plug and jack connectors, a resulting phase shift between existing and compensating crosstalk signals may prevent the signals from completely canceling one another. That is, while capacitive crosstalk compensation is desirable since it may be applied over relatively short lengths of the contact wires of a connector, the point at which such compensation is introduced should be as close as possible to the source of offending crosstalk, e.g., a mating plug.

SUMMARY OF THE INVENTION

According to the invention, a communication connector includes a connector housing having an opening for receiving a mating connector. At least a first and a second pair of terminal contact wires are supported in the housing, and each pair of contact wires forms a different signal path. The terminal contact wires have base portions, free ends, and generally co-planar intermediate contact portions for establishing points of electrical contact with corresponding terminals of the mating connector. First and second pairs of elongated, parallel capacitor plates are fixed at corresponding free ends of the terminal contact wires. Each pair of capacitor plates are dimensioned and arranged for capacitively coupling an associated terminal contact wire of one pair of contact wires with an associated terminal contact wire of the other pair of contact wires, to produce capacitive crosstalk compensation substantially close to the points of electrical contact between the contact wires and the mating connector. Each pair of capacitor plates extend in a direction substantially parallel to the plane of the contact portions of the terminal contact wires.

In the disclosed embodiment, the first and the second pairs of parallel capacitor plates also extend in a direction perpendicular to the free ends of the terminal contact wires, and are aligned in planes orthogonal to one another.

For a better understanding of the invention, reference is made to the following description taken in conjunction with the accompanying drawing and the appended claims.

DETAILED DESCRIPTION OF THE INVENTION

Figure 1:
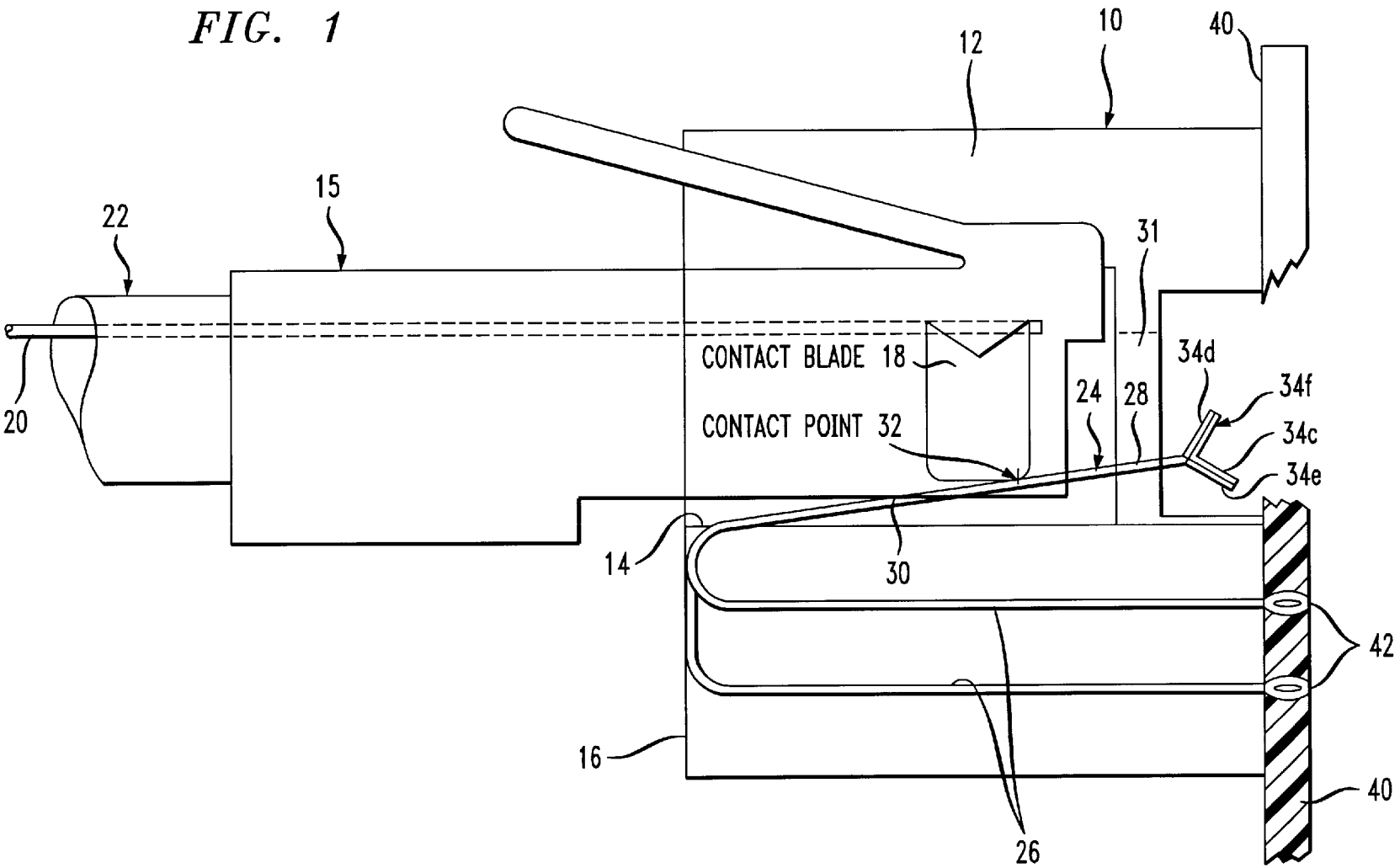
FIG. 1 is a side view of a communication connector according to the invention, and a mating plug.
Figure 2:
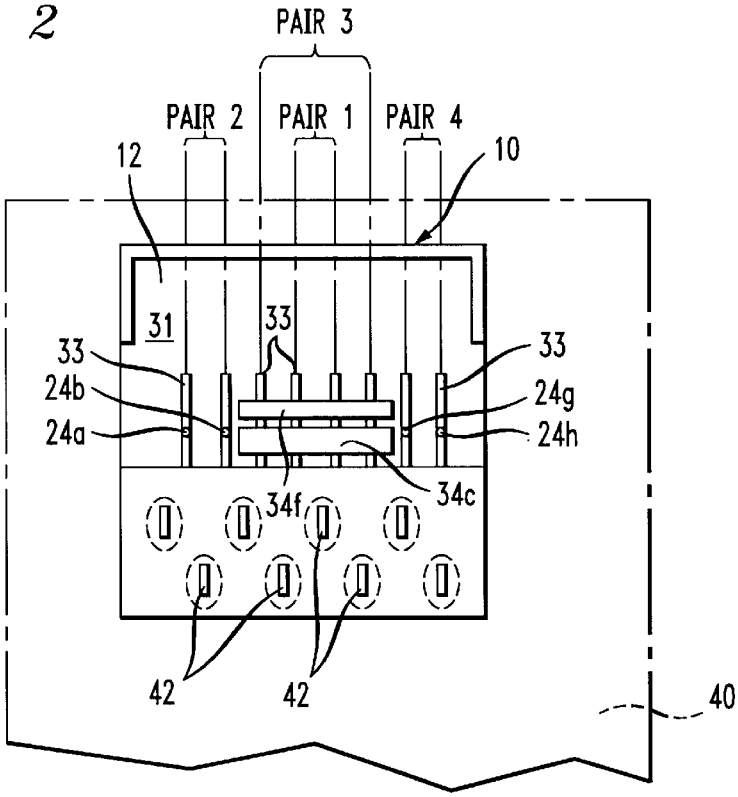
FIG. 2 is an end view of the connector as seen from the right side in FIG. 1.

FIG. 1 is a side view of a communication connector 10 according to the invention. FIG. 2 is an end view of the connector 10 as seen from the right in FIG. 1.

The connector 10 includes a connector frame or housing 12 having an opening 14 for receiving a mating connector 15 in a side wall 16 of the housing, at the left in FIG. 1. In the illustrated embodiment, the mating connector is a typical RJ-45 communication plug. The plug 15 has, e.g., eight contact blade terminals 18, one of which is seen in FIG. 1. Each of the blade terminals 18 of the plug 15 may terminate a corresponding cable wire lead 20 among, e.g., four twisted pairs of wire leads carried by an associated cable 22.

The configuration of the connector housing 12 of the communication connector 10 may resemble, without limitation, the housing of a current printed wiring board jack, e.g., type 657C available from Lucent Technologies, Inc. In the disclosed embodiment, eight terminal contact wires 24 are supported in the housing 12. The terminal contact wires have base portions 26, free ends 28, and contact portions 30 that extend between the base portions 26 and the free ends 28. The contact portions 30 are generally parallel and define a co-planar region with one another, as seen in FIG. 1. The contact portions 30 of the contact wires 24 establish points 32 of electrical contact with corresponding blade terminals 18 of the plug 15 when the plug is received in the connector housing opening 14, as shown in FIG. 1. The connector housing 12 includes a rear wall 31 having a number (e.g., eight) of equi-spaced vertical slots 33 as shown in FIG. 2. The free ends of individual terminal contact wires 24*a* to 24*h* are guided for vertical movement within corresponding slots 33, as the plug blade terminals 18 urge the contact portions 30 of the terminal contact wires downward in FIGS. 1 and 2.

The terminal contact wires 24 may be formed of a copper alloy such as beryllium copper, spring-tempered phosphor bronze, or the like. A typical cross-section for each contact wire 24 is approximately 0.015 inches wide and about 0.010 inches high, as seen at the free ends of terminal contact wires 24*a,* 24*b,* 24*g* and 24*h,* in FIG. 2.

In the following disclosure, different pairs of the terminal contact wires 24 are numbered and individual wires are identified as below with reference to FIG. 2. Each of the numbered pairs forms a corresponding signal path through the connector 10.

| Pair Number | Contact Wires |
|---|---|
| 1 | 24d, 24e |
| 2 | 24a, 24b |
| 3 | 24c, 24f |
| 4 | 24g, 24h |

The pair 1 terminal contact wires 24*d* and 24*e,* extend between the pair 3 contact wires 24*c* and 24*f.* Elongated capacitor plates 34*d* and 34*e* are formed at the free ends of the pair 1 contact wires, and elongated capacitor plates 34*c* and 34*f* are formed at the free ends of the pair 3 contact wires. The capacitor plates 34*c*–34*f* extend in a their long directions substantially parallel to the co-planar region of the contact portions 30 of the terminal contact wires 24, and perpendicular to the free ends contact wires. See FIGS. 1 to 4.

Capacitor plate 34*c* is aligned parallel to plate 34*e,* with a dielectric material D1(e.g., a 0.010 inch thick polyester film) sandwiched between the plates 34*c,* 34*e.* Thus, contact wire 24*c* of the pair 3 contact wires is capacitively coupled with contact wire 24*e* of the pair 1 contact wires. Likewise, capacitor plate 34*d* is aligned parallel to plate 34*f* with a dielectric material between the plates, for capacitively coupling terminal contact wire 24*d* of the pair 1 contact wires with contact wire 24*f* of the pair 3 contact wires.

The amount of capacitive coupling provided by each pair of capacitor plates, is a function of the areas of the parallel plates and the thickness and dielectric constant of the material between the plates. Values in the order of 1.0 picofarads should be obtainable. As a result, capacitive crosstalk compensation is provided for signals carried by the pair 1 and pair 3 contact wires, and is developed substantially close to the points 32 of electrical contact with the mating plug 15.

Figure 3:
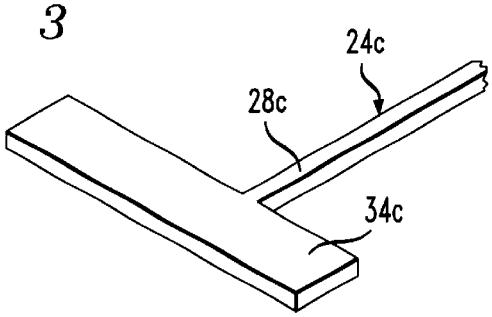
FIG. 3 is a perspective view of a connector terminal contact wire formed with a capacitor plate at a free end of the wire, according to the invention.
Figure 4:
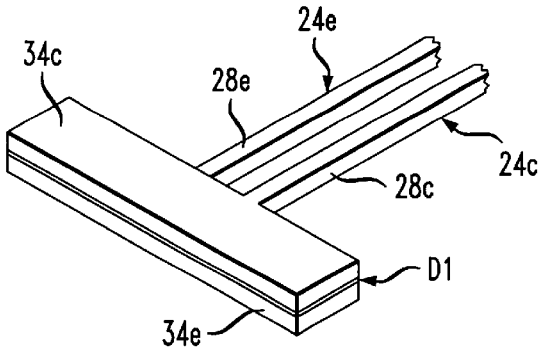
FIG. 4 is a perspective view of two terminal contact wires arranged with parallel capacitor plates at the free ends of the wires, according to the invention.

Each capacitor plate may be formed integrally at the free end of an associated contact wire, and stamped out with the contact wire as shown in FIG. 3. Each pair of parallel capacitor plates 34*c* & 34*e,* and 34*d* & 34*f,* are encapsulated with the dielectric sandwiched between them using a suitable coating. For example, the plates may be dipped in a coating solution which is subsequently cured by exposure to ultra-violet (UV) light. Such encapsulation maintains the desired capacitances and prevents high voltage breakdown between the plates.

As seen in FIG. 1, the distance between the connector contact points 32 and the bodies of the capacitor plates 34, is minimal. The configuration allows compensating crosstalk produced by the capacitor plates to be introduced substantially at the plug/connector interface, and the effectiveness of the crosstalk compensation is thus enhanced due to minimal propagation delays.

Because the free ends of not more than two terminal contact wires are joined for movement with one another by an encapsulated pair of capacitor plates at the free ends of the terminals, all of the contact wires 24 will nonetheless make reliable contact with the contact blades 18 of the mating plug 15, even if the blade terminals 18 vary slightly from one another in vertical position in FIG. 1. Further, crosstalk compensation between contact wire pairs 1 & 2; 1 & 4; 2 & 3; and 3 & 4; may be achieved elsewhere along the lengths of the terminal contact wires from the contact points 32 to an outside printed circuit board 40 (see FIG. 1), since any crosstalk induced among the mentioned pairs is typically less severe than that induced between pairs 1 & 3.

As seen in FIG. 1, capacitor plate pair 34*c* & 34*e,* and capacity plate pair 34*d* & 34*f,* are aligned in planes that are orthogonal to one another. This configuration avoids physical interference between the two pairs of parallel capacitor plates, and also avoids any undesirable cross-coupling between the two pairs of plates.

The base portions 26 of the contact wires 24 are supported in corresponding channels formed horizontally in a lower portion of the connector housing 12. See FIG. 1. As shown in FIG. 2, the base portions of the contact wires form corresponding terminals 42. The terminals 42 may have a "needle-eye" configuration for insertion in terminal openings formed in a corresponding pattern in the outside circuit board 40.

The terminal contact wires 24 including the capacitor plates 34 and the terminals 42 can be manufactured, for example, in the form of a lead frame assembly using existing production facilities. Manufacturing costs may be kept low, and the production yield high for such contact wire lead frames. Further, the cost of the outside circuit board 40 may be reduced, since fewer, if any, stages of additional crosstalk compensation will be required on or within the board 40.

EXAMPLE

Figure 5:
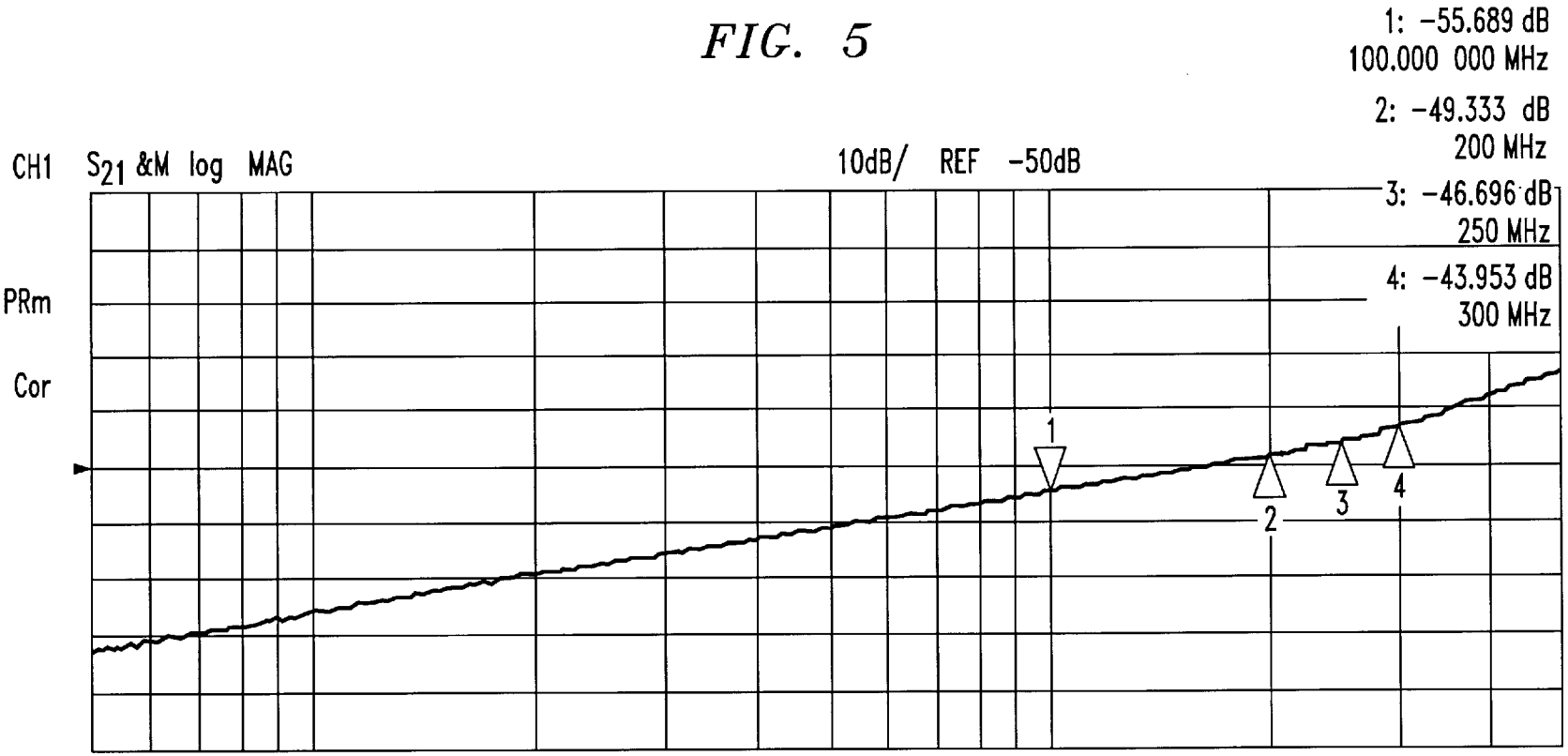
FIG. 5 is a graph showing measured near end crosstalk (NEXT) between two pairs of terminal contact wires having capacitive crosstalk compensation coupling, according to the invention.

A type 657C jack was modified to include the capacitor plates 34 at the free ends of terminal contact wire pairs 1 and 3, per the present disclosure. FIG. 5 is a graph of measured near end crosstalk (NEXT) for wire pairs 1 & 3. The measured results show crosstalk between pairs 1 & 3 equal to −46.696 dB at 250 MHz, thus meeting TIA category 6 requirements. As mentioned, overall performance may be further enhanced with stages of compensation on or within the outside circuit board 40.

While the foregoing description represents a preferred embodiment, it will be obvious to those skilled in the art that various changes and modifications may be made, without departing from the spirit and scope of the invention pointed out by the following claims.

I claim:

1. A communication connector, comprising:

a connector housing having an opening for receiving a mating connector;

at least a first and a second pair of terminal contact wires supported in the housing, and each pair of contact wires forms a different signal path;

the terminal contact wires have base portions, free ends, and intermediate contact portions defining a co-planar region for establishing points of electrical contact with corresponding terminals of the mating connector;

a first pair of parallel, elongated capacitor plates fixed at corresponding free ends of the first pair of terminal contact wires, and a second pair of parallel elongated capacitor plates fixed at corresponding free ends of the second pair of terminal contact wires, wherein each pair of capacitor plates is dimensioned and arranged for capacitively coupling an associated terminal contact wire of the first pair of contact wires with an associated terminal contact wire of the second pair of contact wires, to cause capacitive crosstalk compensation to be introduced at said points of electrical contact between the contact wires and the mating connector;

wherein the long direction of each pair of capacitor plates is parallel to the co-planar region of the contact portions of the terminal contact wires; and the first pair of capacitor plates is aligned orthogonal to the second pair of capacitor plates to reduce interference and cross coupling between the two pairs of capacitor plates.

2. A communication connector according to claim 1, wherein the long direction of each pair of capacitor plates is perpendicular to the free ends of the terminal contact wires.

3. A communication connector according to claim 1, including a dielectric material sandwiched between the plates of each pair of parallel capacitor plates.

4. A communication connector according to claim 3, wherein the dielectric material is a polyester film.

5. A communication connector according to claim 4, wherein the polyester film is about 0.010 inch thick.

6. A communication connector according to claim 1, wherein the first and the second pair of capacitor plates are formed integrally with the corresponding one of the terminal contact wires.

7. A communication connector according to claim 6, wherein the capacitor plates are stamped out with the associated terminal contact wires.

8. A communication connector according to claim 1, wherein the first pair of terminal contact wires extends between the second pair of terminal contact wires.

9. A communication connector according to claim 1, wherein the connector housing includes a rear wall having a number of equi-spaced slots for guiding the free ends of the terminal contact wires for vertical movement when the terminals of the mating connector engage the contact portions of the terminal contact wires.

10. A communication connector according to claim 1, wherein each of the first and the second pair of capacitor plates is encapsulated with the dielectric material between the plates.

* * * * *